United States Patent [19]

Tiller

[11] Patent Number: 5,007,635

[45] Date of Patent: Apr. 16, 1991

[54] EXERCISE DEVICE

[76] Inventor: Ralph Tiller, 1534 Old Creek Ct., Cardiff, Calif. 92007

[21] Appl. No.: 336,720

[22] Filed: Apr. 12, 1989

[51] Int. Cl.[5] ..... A63B 21/06; A63B 21/00

[52] U.S. Cl. ..... 272/117; 272/119

[58] Field of Search ..... 272/135, 137, 136, 142, 272/900, 93, 116, 74, 75, 143, 117, 119; 273/29 A, 35 R, 191 B, 193 A, 194 R, 194 A, 26 B; 2/415

[56] References Cited

U.S. PATENT DOCUMENTS

| | | | |
|---|---|---|---|
| 629,655 | 7/1899 | Bryon, Jr. | 272/136 |
| 2,085,320 | 6/1937 | Kolstrand | 272/142 |
| 2,788,214 | 4/1957 | Tilden | 273/191 |
| 2,848,234 | 8/1958 | Brandon | 273/35 |
| 3,462,156 | 8/1969 | Gentry | 273/186 |
| 3,677,543 | 7/1972 | Richardson | 272/82 |
| 3,807,730 | 4/1974 | Dalton et al. | 272/82 |
| 4,019,734 | 4/1977 | Lee et al. | 272/137 |
| 4,073,490 | 2/1978 | Feather | 272/136 |
| 4,385,759 | 5/1983 | Everroad | 272/75 |
| 4,505,474 | 3/1985 | Mattox | 272/75 |
| 4,544,155 | 10/1985 | Wallenbrock et al. | 272/136 |
| 4,647,037 | 3/1987 | Donohue | 272/75 |
| 4,659,078 | 4/1987 | Blome | 272/128 |
| 4,728,103 | 3/1988 | Fulton | 272/137 |
| 4,733,862 | 3/1988 | Miller | 272/137 |
| 4,919,417 | 4/1990 | Poulas | 272/74 |

FOREIGN PATENT DOCUMENTS

| | | | |
|---|---|---|---|
| 43389 | 1/1888 | Fed. Rep. of Germany | 272/142 |

OTHER PUBLICATIONS

The Lifeline Gym, advertisement from The Lifestyle Resource Company.

*Primary Examiner*—Richard J. Apley
*Assistant Examiner*—Jerome W. Donnelly
*Attorney, Agent, or Firm*—David J. Harshman

[57] ABSTRACT

An exercise device includes a hollow flexible elastic tube filled with fluid having hook members connected in the ends thereof for detachably securing the tube to the hook members. The hook member includes first and second wedge-shaped portions for facilitating insertion of the hook during assembly of the device, and for lockingly engaging the hook member, along with the retaining ring, to the end of the tube. Further included is a substantially cylindrical, hollow handle for use in improving a golf swing, which includes a slot formed in the handle for removably receiving the stretchable tube and for holding the end of the tube within the handle.

14 Claims, 2 Drawing Sheets

EXERCISE DEVICE

FIELD OF THE INVENTION

This invention relates generally to devices for exercising the human body. More particularly, this invention relates to an exercise device for strengthening muscles, tendons, and ligaments which is portable. This invention is particularly, but not exclusively, useful for improving one's golf club swing.

BACKGROUND OF THE INVENTION

Over the years, many types of exercise devices have been developed to allow a user to improve and maintain muscle tone and condition. Many such devices have been developed for use outside the gym, such as in the home. Such devices include rubber cord expanders having a pair of handles attached to the ends thereof. Such devices, however, are bulky and inconvenient to carry and store because of the size and shape of the handles. The handles are often wood, plastic, or other material mounted in complicated fashion, often by rings of steel or hard plastic to the rubber cord. In addition, coil springs are often utilized in conjunction with the rubber cord. Also, because of the bulky and complicated construction of prior art devices, there is a risk that the handles can break or become disengaged from the rubber material cord which can result in the device becoming inoperable.

Moreover, in conventional prior art devices, the materials utilized include solid rubber material which is often more difficult to stretch, and thus is not as adaptable for use by a wide variety of users with different strengths and needs for exercise. In addition, such prior art devices of solid rubber which typically require greater strength to stretch, normally do not allow a wide range of motion of the body muscles and parts being exercised, whether it is the arms, legs, head, torso, or the like.

Conventional exercise devices utilized to assist in the golf club swing for users are particularly complicated. Such exercise devices for golf and improving one's golf club swing often involve attaching the device to a wall or other structure in permanent fashion, and further, because of such complicated structure such prior art devices tend to be costly to manufacture and use. In addition, such prior art devices do not assure the build up of the proper muscles needed to improve one's golf swing.

Accordingly, it is an object of the present invention to provide a portable exercise device which is convenient and easy to use. It is a further object of the present invention to provide an exercise device which can be easily adapted to be utilized for improving the golf swing of the user. Another object of the present invention is to provide an exercise device which strengthens primarily those muscles utilized in a proper golf swing. Still another object of the present invention is to provide an exercise device which is convenient to use, cost effective and easily manufactured.

SUMMARY OF THE INVENTION

A preferred embodiment of the exercise device of the present invention includes an elongated elastic hollow tube having a first and second end, the hollow tube being filled with fluid. Hook members are fixedly mounted in the first and second ends of the tube for detachably securing the tube to the hook, and for sealing the fluid in the hollow tube. The hook member includes a first wedge-shaped portion formed to facilitate insertion of the hook member into the ends of the tube, a retaining ring, and a second wedge-shaped portion formed to cooperate with the retaining ring to lockingly engage the tube onto the hook members. Also included is a substantially cylindrical, hollow handle formed in the shape of a golf club handle, with a slot therein for removably receiving one end of the tube, the handle also being formed to restrain the end of the tube from being pulled out of the hollow handle. With this device, the golfer can easily determine when his swing is in the correct swing plane.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENTS

Figure 1:
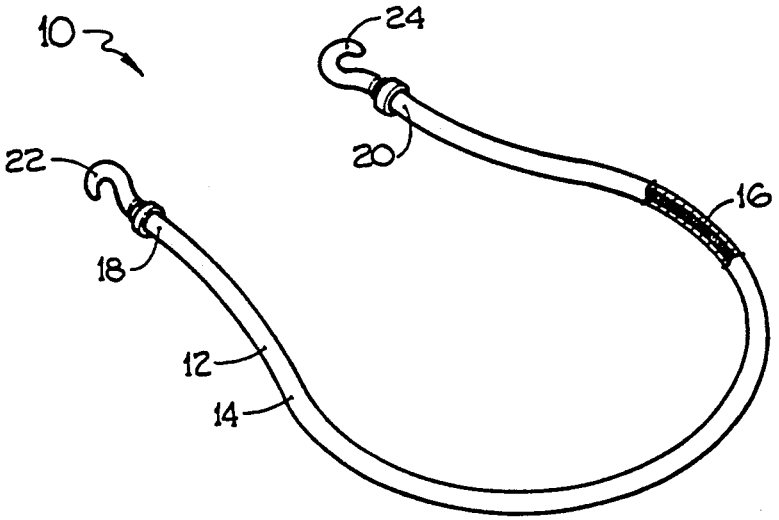
FIG. 1 is a perspective view of an exercise device in accordance with the present invention having a partially cut away section.

FIG. 1 shows one embodiment of the exercise device of the present invention generally designated 10. The exercise device 10 comprises tubular elastic material or tube 12. The tube is hollow and flexible, and has a lumen 14. The tube 12 is preferably surgical tubing or the like, as opposed to a solid rubber. Tube 12 is readily stretchable so as to permit a wide range of movement in the muscles of the user in utilizing the exercise device. Typically, the surgical tubing is approximately seven-sixteenths of an inch (0.4375 in.) in outside diameter, and has an inside diameter of approximately one-fourth of an inch (0.250 in.). Contained inside the lumen 14 of the tube 12 is a fluid 16. The fluid 16 is preferably a nontoxic fluid which may be clear or colored, with water being a fluid which would work well with the present invention.

Figure 1A:
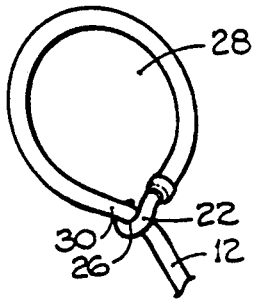
FIG. 1A is a perspective view of one end of the exercise device of FIG. 1 illustrating the manner in which a hook member in one end of the device cooperates to detachably secure the device in a loop.

Tube 12 has a first end 18 and a second end 20. In first end 18, there is fixedly attached a hook member 22, and in second end 20 there is fixedly attached a hook member 24, as will be more fully explained below. Hook members 22, 24 are made of a suitable rigid material which serves the purpose of having sufficient strength to detachably secure a portion of tube 12 to the hook member as shown at 26 of FIG. 1A. As shown in FIG. 1A, there is formed a loop 28 of tube 12 by the hook 22, for example, having the tube portion 30 inserted into the hook 22. This allows the tube 12 to be conveniently looped about various objects, such as the ankles, arms and the like, or as will become more apparent below, about a fixed stationary object such as a doorknob, table leg or the like, to detachably secure the exercise device to the appropriate object as desired.

Figure 2:
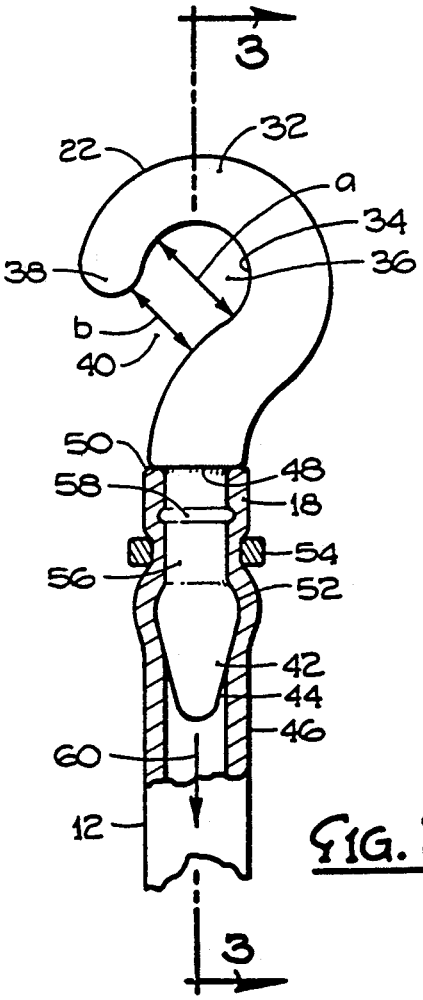
FIG. 2 is a side view of one end of the exercise device of FIG. 1 illustrating a hook member inserted in a tube, partially in cross section.
Figure 3:
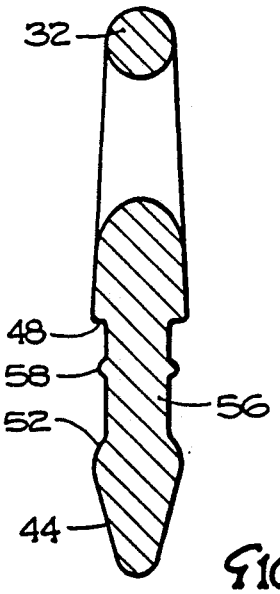
FIG. 3 is a cross section, taken along lines 3—3 of the hook member shown in FIG. 2.

Referring now to FIG. 2, there is shown a hook member 22 in more detail. In particular, hook member 22 includes a substantially J-shaped catch portion 32, having an inner catch portion 34 defining an eye 36 of the hook member 22. The eye 36 has a diameter substantially the same as that of the tube 12 in order to facilitate insertion of the tube 12 into eye 36 of hook member 22. Catch portion 32 further includes a tip portion 38 which extends a sufficient distance to form a narrowed channel 40 having a width "b" which is less than the diameter "a" of eye 36. This facilitates insertion of tube 12 filled with fluid 16 into eye 36 and retains the tube 12 within eye 36 to detachably secure the tube 12 therein. Insertion of tube 12 through narrow channel 40 into eye 36 of hook member 22 causes a compression of the fluid and a slight expansion of the elastic tubing 12. Once the tube is seated inside eye 36, it is prevented from falling out of eye 36 by the elastic action of tube 12. Because tube 12 is filled with fluid, it resists compression and therefore the tube is detachably secured within the hook member 22, and does not fall out, but yet can be readily removed by the user if desired. Thus, inadvertent detachment is minimized due to the structure of the apparatus as explained hereinabove.

Further, with respect to FIG. 2, hook member 22 is attached to tube 12 as illustrated therein. In particular, hook member 22 further includes a first wedge-shaped portion 42 formed to facilitate insertion of the hook member 22 into the first end 18 of tube 12. First wedge-shaped portion 42 has an outer wall 44 which facilitates assembly by allowing hook member 22 to slide into tube 12 by gradually opening and compressing wall 46 of tube 12 until the abutment 48 engages end 50 of tube 12. Hook member 22 further includes a second wedge-shaped portion 52 formed to cooperate with a retaining ring 54 positioned about the tube 12 and a shaft portion 56. Also included is a ridge portion 58 between abutment 48 and second wedge-shaped portion 52 to hold the retaining ring 54 in place adjacent the second wedge-shaped portion 52.

When exercise device 10 is stretched, and force is applied on tube 12 to pull the tube away from hook member 22, the tube 12 pulls generally in the direction of arrow 60. This causes the retaining ring 54 to be pulled along with tube 12 generally in the direction of arrow 60 until retaining ring 54 engages the second wedge-shaped portion 52 to lockingly engage the tube onto the hook member. Additional force only further restrains and tightens the engagement between retaining ring 54, tube wall 46, and second wedge-shaped portion 52 to tighten the hold. In addition, it may be convenient to utilize an adhesive on the inside of the hollow tube 12 when inserting hook member 22 to provide additional sealing engagement, having a side benefit of additional adhesion. However, if the adhesive should deteriorate, the locking engagement of the second wedge portion would nevertheless allow a secure connection to remain.

Figure 4:
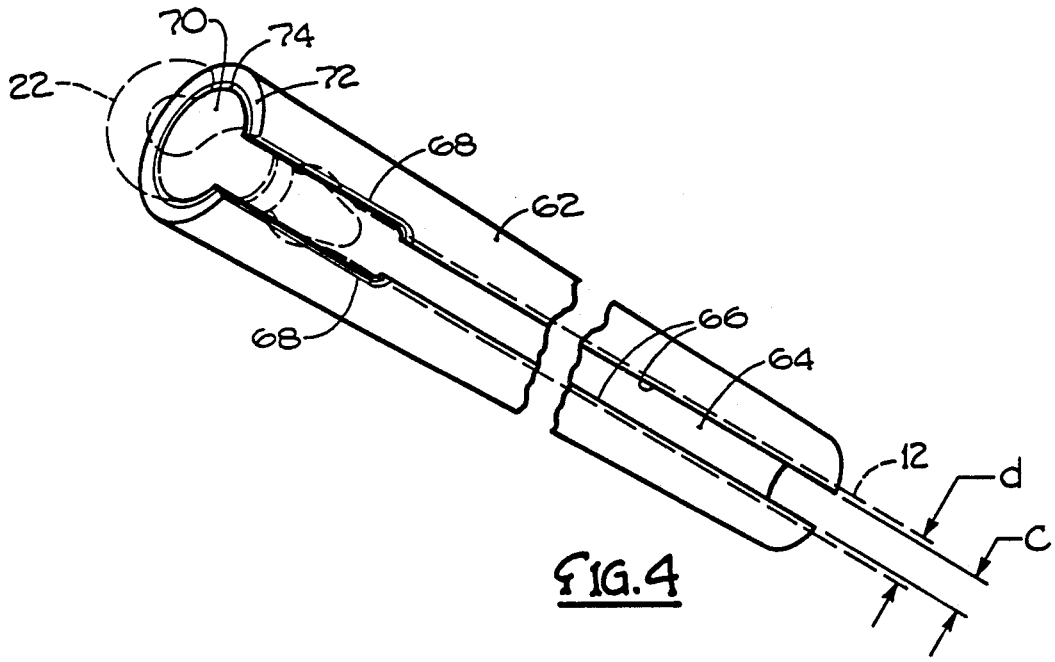
FIG. 4 is a schematic diagram of a handle incorporated with the exercise device of the present invention.

Referring now to FIG. 4, there is shown a handle 62 for use in conjunction with the exercise device 10 of the present invention. Handle 62 is shown in cooperation with tube 12 and hook member 22 shown in phantom dashed lines. Handle 62 is a substantially cylindrical hollow handle. It is formed with a slot 64 extending the entire length of the handle 62. Slot 64 includes edges 66 and a notched edge portion 68. Notched edge portion 68 is widened to accommodate and facilitate insertion of hook member 22 and allow seating of hook member 22 into the top open end 70 of handle 62. Slot 64 has a width "c" which is greater than the diameter of tube 12 when tube 12 is in a narrowed, stretched condition which allows insertion of the tube 12, and the hook member 22 into handle 62. When tube 12 is returned to its normal, unstretched condition, tube 12 expands to its normal width "d", which is greater than the slot width "c" so that tube 12 is then restrained within handle 62. Thus, tube 12 is conveniently secured within handle 62, yet can be easily removed therefrom by stretching tube 12 to make it narrow enough to slip out of slot 64 and remove handle 62 from the end of tube 12.

Figure 5:
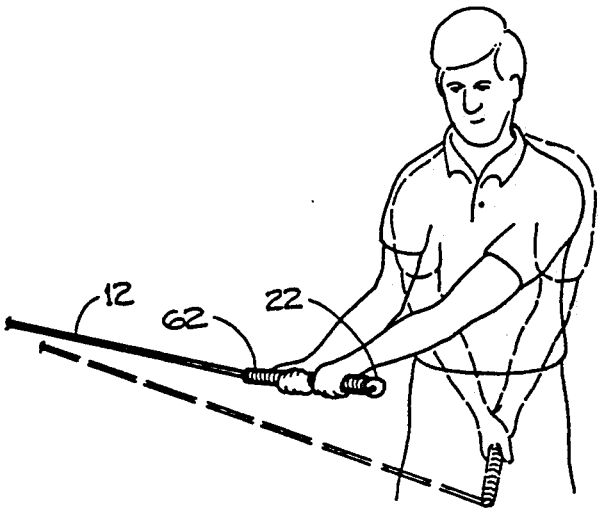
FIG. 5 is an illustration of a user utilizing the exercise device of the present invention in improving a golf swing.

Referring now to FIG. 5, there is an illustration of the user of the device 10 utilizing the exercise device of the present invention with handle 62 secured to tube 12. The opposite end of tube 12 is looped as is shown in FIG. 1A about a door handle or other stationary object which is conveniently available to the user thereof. The user then can go through the motion of a golf swing utilizing the handle 62 and experience the resistance to the swing by virtue of the elastic property of tube 12. The handle 62 is preferably in the shape of a golf club handle and may have conventional golf club gripping cover material 72 bonded to a rigid inner layer 74, preferably of metal, hard plastic or other rigid material. Also, in use, the user is instructed to turn handle 62 so that in the process of the golf swing, the tube 12 does not inadvertently slip out of slot 64 during the process of the swing. During the swing, it is taught in the proper use of the exercise device 10 that as the user addresses the position where the ball would lie during the first part of the swing, and as the user moves through the first half of the swing, that tube 12 should remain in a straight line defining a plane perpendicular to the floor. Movement of the tube outside of the straight line and plane indicates an incorrect swing. Accordingly, use of the present exercise device 10 for purposes of improving a golf swing tends to strengthen mainly those muscles required for a proper swing.

It is readily apparent that the present exercise device offers unique advantages not heretofore recognized in conventional devices, and allows a convenient, easy-to-use exercise device for improving muscle strength and body tone in a convenient, portable easy-to-use manner, having a durable construction and ease of manufacture.

Further, in another method of use of exercise device 10, each end of the exercise device can be conveniently looped about the ankles of an individual with the middle portion of the tube wrapped around a stationary object, and the user can then attempt to walk "upstream". This provides excellent exercise of the front and outside muscles of the legs, as well as the abdominal muscles. Moreover, the device can be looped a number of times to provide additional resistance to stretching between the hands and the like.

While the particular exercise device as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

What is claimed is:

1. An exercise device, comprising:

an elongated elastic hollow tube having a first and second end, said hollow tube being filled with a liquid fluid; and hook means fixedly mounted in said first and second ends for detachably securing said tube to said hook means and for sealing said liquid fluid within said first and second ends of said tube;

said tube being filled with said liquid fluid so that compression of one portion of said liquid fluid filled tube results in elastic expansion of other portions of said tube.

2. An exercise device as recited in claim 1, wherein said hook means includes a first wedge-shaped portion formed to facilitate insertion of said hook means into said ends of said hollow tube, a shaft portion, a retaining ring positioned about said tube and shaft portion, and a second wedge-shaped portion formed to cooperate with said retaining ring to lockingly engage said tube onto said hook means.

3. An exercise device as recited in claim 2, wherein said hook means has an eye having a diameter approximately the same as the outside diameter of said tube.

4. An exercise device as recited in claim 3, wherein said tube comprises latex rubber.

5. An exercise device as recited in claim 3, wherein said hook is comprised of polyamide, or other plastic.

6. An exercise device, comprising:

an elongated elastic hollow tube having a first and second end, said hollow tube being filled with a fluid;

hook means fixedly mounted in said first and second ends for detachably securing said tube to said hook means and for sealing said fluid within said first and second ends of said tube;

said tube being filled with said fluid so that compression of one portion of said fluid filled tube results in elastic expansion of other portions of said tube; and a substantially cylindrical hollow handle, said handle having a slot formed therein for removably receiving said first end including said hook means into said hollow handle for holding said end of said tube within said handle.

7. An exercise device as recited in claim 6, wherein said handle comprises a rigid inner layer of material, and a soft flexible outer layer of material.

8. An exercise device as recited in claim 7, wherein said slot includes a portion having a width less than the outside diameter of said tube when said tube is stretched.

9. An exercise device as recited in claim 8, wherein said slot includes a hook means receiving portion at one end thereof having a width sufficient for receiving said hook means.

10. An exercise device comprising in combination:

a hollow flexible elastic tube having a lumen filled with a fluid, said tube having a first end and a second end;

sealing means for sealing said fluid in said ends of said tube;

hook means connected to at least one of said sealing means for detachably securing a portion of said tube to said hook means; and a substantially cylindrical hollow handle formed with a slot therein for removably receiving one said end of said tube, said handle having means for restraining said end of said tube from being pulled out of said hollow handle.

11. An exercise device as recited in claim 10, wherein said sealing means comprises a wedge-shaped portion inserted in said one end of said tube.

12. An exercise device as recited in claim 11, wherein said sealing means includes an adhesive.

13. An exercise device as recited in claim 11, wherein said sealing means includes a retaining ring positioned on the outside of said tube adjacent said wedge-shaped retaining portion to hold said tube on said sealing means.

14. An exercise device as recited in claim 10, wherein said slot has a width greater than the diameter of said tube when said tube is in a narrowed, stretched condition to allow insertion thereof into said slot, but smaller than the diameter of said tube when said tube is in a normal unstretched condition to retain said tube in said handle.

* * * * *